United States Patent [19]

Riss

[11] 4,131,074

[45] Dec. 26, 1978

[54] METHOD OF AND APPARATUS FOR THE SEWING OF A MULTIPLICITY OF STITCH GROUPS IN A WORKPIECE

[75] Inventor: Gerhard Riss, Bielefeld, Germany

[73] Assignee: Dürkoppwerke GmbH, Bielefeld, Germany

[21] Appl. No.: 847,050

[22] Filed: Oct. 31, 1977

[30] Foreign Application Priority Data

Nov. 3, 1976 [DE] Fed. Rep. of Germany ..... 2650334

[51] Int. Cl.[2] ..... D05B 3/00; D05B 33/00; D05B 81/00

[52] U.S. Cl. ..... 112/121.14; 112/121.29; 112/65

[58] Field of Search ..... 112/121.14, 121.29, 112/65, 3 R

[56] References Cited

U.S. PATENT DOCUMENTS

| | | | |
|---|---|---|---|
| 2,944,496 | 7/1960 | Garner | 112/65 |
| 3,082,719 | 3/1963 | Zeitlin | 112/65 |
| 3,323,476 | 6/1967 | Kass | 112/65 |
| 3,371,630 | 3/1968 | Cash | 112/121.14 |
| 3,837,305 | 9/1974 | Cash | 112/3 R |
| 3,878,801 | 4/1975 | Conner | 112/121.29 |
| 4,067,277 | 1/1978 | Solomon et al. | 112/121.14 |

*Primary Examiner*—Ronald Feldbaum
*Attorney, Agent, or Firm*—Karl F. Ross

[57] ABSTRACT

A method of and apparatus for the sewing of a succession of stitchgroups on a workpiece and for the feeding of a new workpiece into sewing position, e.g. for producing buttonholes on shirtfronts. The buttonholes are formed by linearly displacing a buttonhole stitching machine stepwise relative to a clamped edge of a fabric workpiece, and a second clamp adjacent the first is provided to retain a second workpiece in position. When the first row of buttonholes is completed upon movement of the machine in one direction, the fabric workpiece, which has been buttonholed, is released, the second fabric is engaged and brought into position, and the sewing machine is displaced in the opposite direction to form a respective row of buttonholes on the new fabric.

13 Claims, 5 Drawing Figures

METHOD OF AND APPARATUS FOR THE SEWING OF A MULTIPLICITY OF STITCH GROUPS IN A WORKPIECE

FIELD OF THE INVENTION

The present invention relates to a method of and an apparatus for the production of a succession of stitch groups in a workpiece and, more particularly, to the production of the succession of buttonholes on a shirt-front.

BACKGROUND OF THE INVENTION

A sewing installation for producing a succession of buttonholes in a fabric workpiece is known, for example, from German Pat. No. 1,086,980. In this case, the workpieces are successively engaged by a tensioning clamping frame and are advanced stepwise with respect to a stationary stitch-group or buttonhole sewing machine. In the rest position between advances of the frame, the two buttonhole stitch beads and the endlocking portions of the buttonhole are stitched and subsequently the fabric is cut through between the beads of stitching.

The sewing of the first buttonhole on each fabric piece takes place at the same end of the piece so that, after completion of the displacement of the frame past the sewing machine for the production of the row of buttonholes, the frame is returned to its original position for the next operating cycle with a new fabric. The return movement of the frame is an unproductive period and limits the output of the machine. The capacity of modern stitch group sewing machines is thus not fully utilized.

OBJECTS OF THE INVENTION

It is one object of the invention to provide a method of forming a succession of stitch groups in a workpiece whereby the aforedescribed dead-time or return movement is eliminated.

Still another object of the invention is to provide an apparatus for carrying out the improved process.

A further object of the invention is to provide a method of operating a sewing machine installation with minimum deadtime or return time.

It is also an object of this invention to provide a method of and an apparatus for the production of rows of buttonholes in a succession of fabrics in a reliable, inexpensive and efficient manner with a minimum of dead time.

SUMMARY OF THE INVENTION

These objects are obtained, in accordance with the present invention, in a method for the formation of a succession of stitch groups in a workpiece, preferably for the production of a row of buttonholes in a shirt-front or the like, whereby during the sewing of the stitch groups the fabric is held in a clamp or stretching device, and the sewing machine and the clamping device are relatively displaced in a stepwise manner to produce the succession of stitch groups or buttonholes.

According to an essential feature of the present invention, the clamping device is held atationary while the sewing machine is displaced in a stepwise fashion to produce the buttonholes or stitch groups.

Another essential feature of the invention resides in stitching each row of stitch groups on each successive fabric piece at the opposite side from that at which the stitch group of the previous fabric piece was started.

In other words, the successive stitch groups are formed in the successive fabric pieces from right to left and left to right, alternately.

This arrangement has the advantage that there is no deadtime during which the clamping device for the fabric and the machine must be moved relatively over the full length of the fabric in preparation for the formation of the next stitch group without the actual production of stitch groups.

A sewing machine installation according to the invention thus is provided with a support, a stitch group sewing machine movable on the support, a clamping device on the support, parallel to the support of the sewing machine, and means for intermittently advancing the sewing machine first in one direction to form a row of buttonholes or stitch groups on a first fabric and then intermittently advancing the sewing machine in the opposite direction to sew a second row of buttonholes on a second fabric workpiece which replaces the first workpiece in the clamping device.

Thus, with respect to the longitudinal direction of displacement of the machine, the clamping device is stationary and can be supplied with additional workpieces particularly conveniently.

According to this invention, a second clamping device is disposed adjacent the first clamping device to hold a second workpiece in readiness, the first clamping device being shiftable toward the second clamping device to take up the second workpiece and carry it into operating position below the sewing machine.

According to a feature of the invention, the means for transfering the fabric workpieces from the second clamping device to the first, the mechanism for dislodging a previously buttonholed workpiece from the first clamping device, etc. are controlled by pneumatic cylinders which are operated in appropriate sequence by programming means and limit switches.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
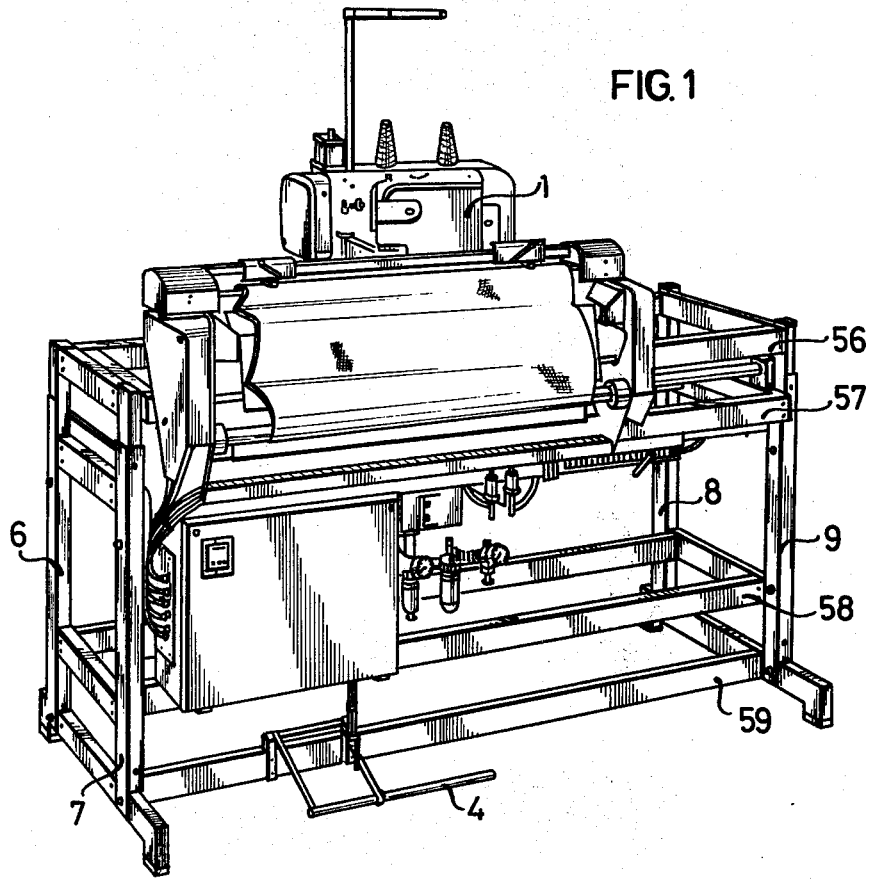
FIG. 1 is an overall perspective view, partly in diagrammatic form, of a sewing machine system embodying the present invention.

The sewing machine installation of the present invention is mounted on a sewing machine frame which can comprise, as can be seen from FIG. 1, four vertical corner posts, composed of tubular steel, 6, 7, 8 and 9 and, on each side, four horizontal beams 56, 57, 58 and 59 which connect the corner posts together. The stitch-group sewing machine designated at 1 can be a conventional Durkopp buttonhole-sewing machine and is movable intermittently and is therefore mounted upon a displaceable carriage for support which is constituted by a rectangular table plate 10 (FIG. 4).

The four corners of the table plate 10 are each provided with a journal block for a ball-bearing bushing of conventional construction. The ball-bearing bushings are disposed in pairs on two slide rails 12 carried by the frame or support 6–9 and 56–59 previously described. In this manner, the table plate 10 is, with low friction, displaceable linearly along the rails 12.

Figure 4:
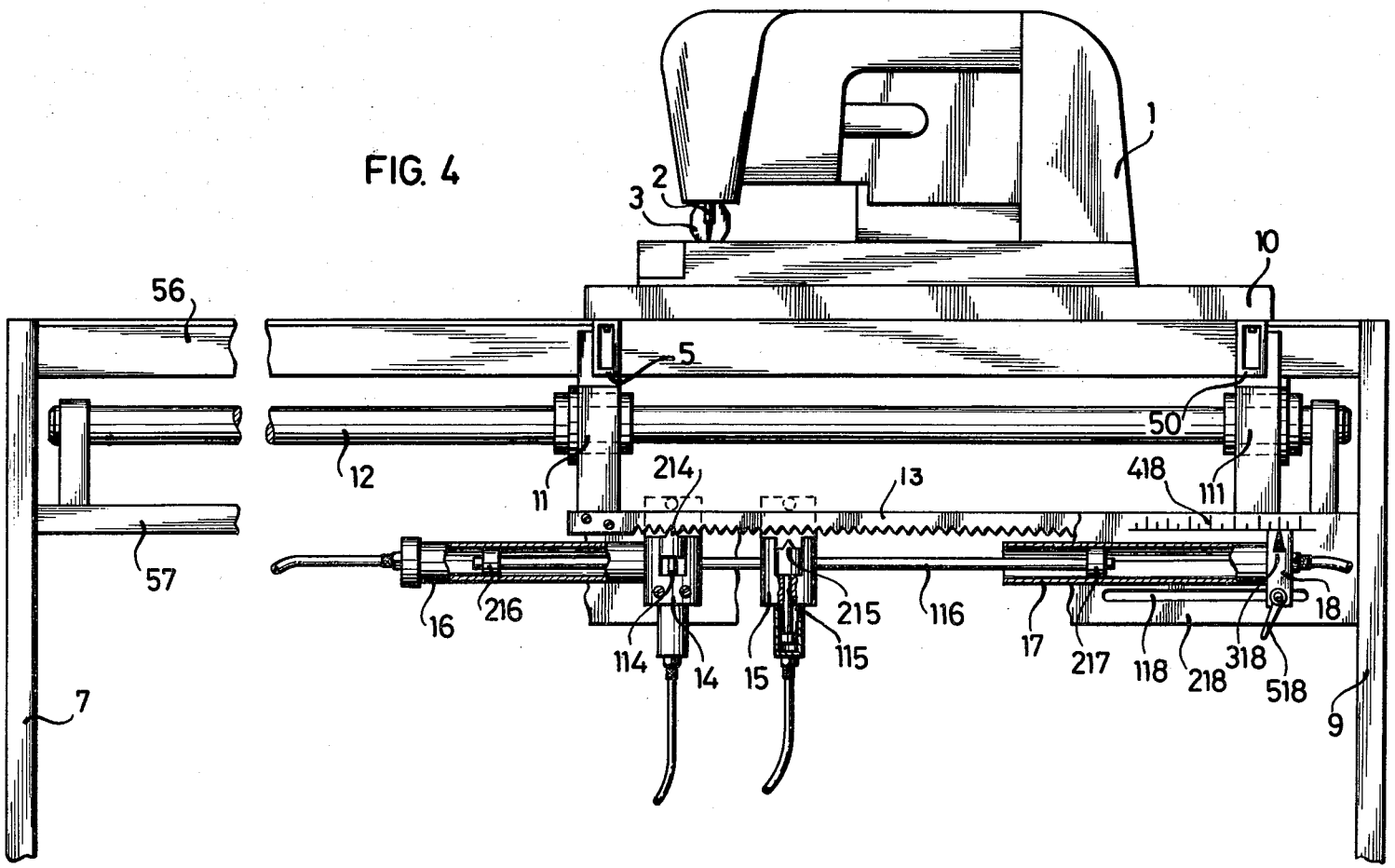
FIG. 4 is a side-elevational view, partly broken away and also partly in diagrammatic form, illustrating the pneumatic actuator for the displacement of the sewing machine.

FIG. 4 shows the table plate 10 in a side view and also illustrates the two journal blocks 5 and 50 on the two corners of the table plate 10 closest to the viewer. Each of these journal blocks 5, 50 carries a respective ball-bearing sleeve or bushing 11, 111.

The opposite side of the table 10, not shown in FIG. 4, and behind the viewing plane, is provided with a similar pair of bearing blocks, respective bushings and the other rail 12.

As indicated previously, the stitch-group sewing machine 1 is an automatic buttonholer of conventional design adapted to form the two bead stitches forming the sides of the buttonhole and the end or locking stitches at the opposite ends of the bead stitches. The buttonhole can be cut through by a blade not seen in the drawing and adapted to pass between the two beads of the buttonhole.

The automatic buttonholer machine of FIG. 1 is provided with a conventional pressurizable raisable and lowerable pressing foot which holds the workpiece against the stitching table and hence retains the same directly adjacent the bead stitches to be formed.

The buttonhole-sewing machine thus not only forms the beads of the buttonhole and the terminuses at the opposite ends thereof, cuts the fabric through between the beads, the produces the necessary number of buttonholes, but also, in the apparatus described, provides for the automatic removal of the finished workpiece and the charging of a new workpiece without manual assistance. The manual operation by the service person is thus limited to the preparation of a new workpiece in such fashion as to enable proper stitching of the buttonholes thereon during the sewing of the previous workpiece.

As noted previously, the stitch-group sewing machine 1 is shiftable intermittently and in a stepwise manner along a fabric workpiece 21. As can be seen from FIG. 2, this workpiece is held in a tensioning device 20. In this illustration, two buttonholes 19 and 119 have been previously sewn and the machine is in position to sew a third buttonhole in the fabric.

Figure 2:
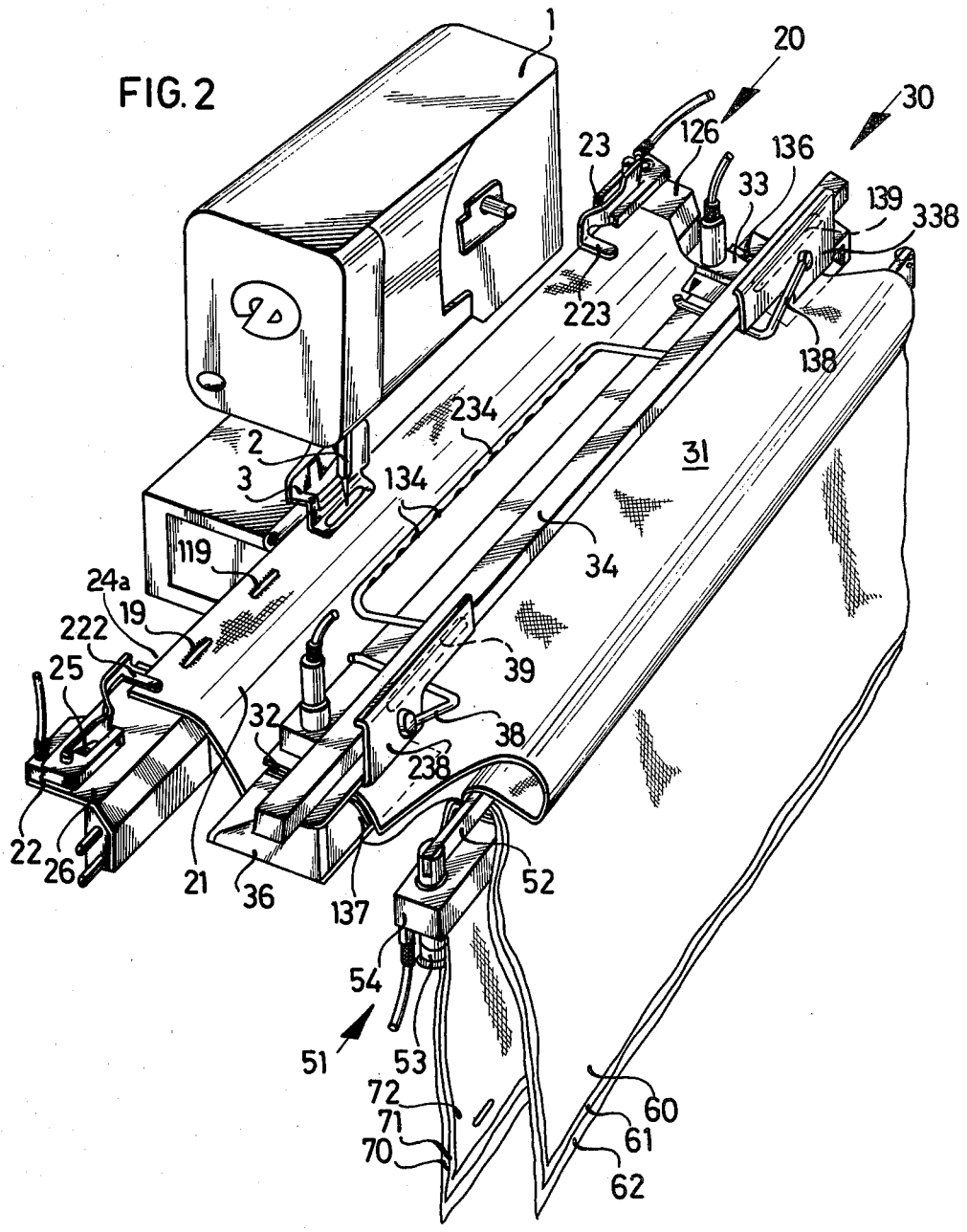
FIG. 2 is a perspective view from above of an automatic sewing machine provided with the device for tensioning the fabric workpiece during the sewing operation, also illustrating the ejecting device.

The stitch-group sewing machine 1 thus moves generally to the right in FIG. 2, i.e. more deeply into the plane of the drawing to sew, in addition to the buttonhole at the position of the needle 2 indicated, two further buttonholes at locations spaced further to the right.

When the first set of buttonholes is completed in the fabric workpiece 21, the workpiece 21 is removed, the next workpiece 31 is shifted into place, and the sewing machine 1 is displaced linearly in the opposite direction to sew the next five buttonholes, the machine 1 moving to the left and out of the plane of the drawing in FIG. 2.

Figure 5:
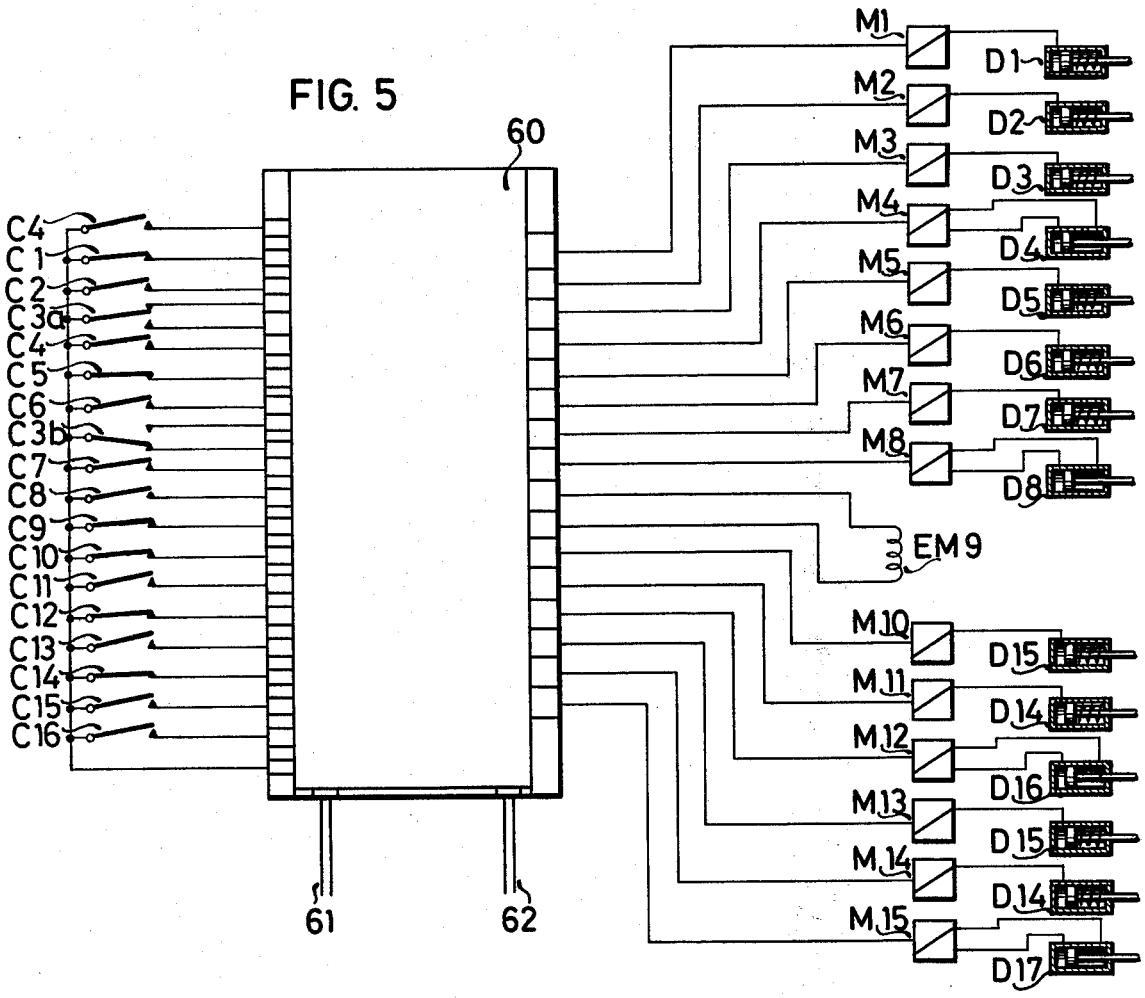
FIG. 5 is a circuit diagram for the appropriate actuation of the fluid pressure cylinders for the displacement of the sewing machine and the charging of the sewing installation with a new workpiece and removal of the completed workpiece.

For the intermittent and stepwise displacement of the machine, in both directions, a pneumatic drive, described below in connection with FIGS. 4 and 5, is provided.

The plate 10 which carries the stitch-group sewing machine 1 is connected via the journal blocks 5 and 50 with a toothed indexing rail 13 whose teeth extend downwardly. This rail is best seen in FIG. 4. Below the indexing rail 13, there are provided a pair if fluid-pressure cylinders (pneumatic cylinders), whose piston rods 114 and 115 are formed with upwardly extending heads carrying indexing teeth 214 and 215, respectively.

The spacing of the indexing cylinders 14 and 15 is so dimensioned that the coupling teeth 214 and 215 on the respective piston rods 114 and 115 can engage in the recesses between teeth of the indexing rail 13 as soon as the respective fluid-pressure cylinders are energized. When the cylinders 14 and 14 are depressurized, the indexing teeth 214 and 215 release the indexing rail 13.

Pneumatic cylinder 14 is fixed to the frame and is attached by screws to a retaining plate 218 which is rigid with the sewing machine frame.

Pneumatic cylinder 15, on the other hand, is fixed to a piston rod 116 (FIG. 4) and is shiftable therewith linearly in the direction of displacement of the sewing machine 1.

The piston rod 116 is provided at its end with a pair of pistons 216 and 217 which are respectively received in opposite pneumatic cylinders 16 and 17 which are alternately energizable (pressurizable).

The two upright pneumatic cylinders 14 and 15 have a relatively short stroke and can be structurally identical.

Pneumatic cylinders 16 and 17 can also be structurally identical but oppositely mounted and the relative distance between them can be adjusted. To this end, the effective stroke length of the piston rod 116 can be varied to adjust, as can be seen subsequently, the spacing of the buttonholes and hence the stepwise displacement per movement of the sewing machine 1.

In the right-hand side of the retaining plate 218 previously mentioned as serving to mount the cylinder 14, there is provided a horizontal slot 118 in which a bracket 18 is guided with a respective roller (not seen) so that this roller and the bracket 18 can be shifted within the slot 118. The bracket 18 is fixed to the right-hand end of the cylinder 17 so that the latter can be shifted along with the bracket 18.

The bracket 18 is provided with an indicating arrow 318 which cooperates with a scale 418 formed on the support plate 218 and providing indicia of the spacing for the buttonholes. A manually operated lever 518 and an associated clamping screw (not seen) permit the adjusting position to be fixed relative to the plate 218, thereby securing the pneumatic cylinder 17 against movement until the lever 518 is again released.

The pneumatic cylinders 14, 15, 16 and 17 are successively energized (pressurized) and form the drive system for the stepwise reciprocation of the stitch-group sewing machine 1.

The tooth 214 of the fluid-pressure cylinder 15 thus describes a generally rectangular movement whereby first it engages the indexing rail 13 in an upper position, is then withdrawn therefrom into a lower position, is displaced to the right or to the left by the cylinders 16, 17, is then raised again to engage the indexing rail 13, and while in engagement therewith is displaced linearly to its original position.

The table 10 which is connected to the indexing rail 13 is thus advanced stepwise by this mechanism.

Referring again to FIG. 2, it will be apparent that, after sewing of the two previously formed buttonholes 19, 119, the pneumatic cylinder 16 is pressurized and the pneumatic cylinder 17 is relieved. The piston rod 116 is displaced to the right while the pressurized piston 15 has its indexing tooth 215 engaged in the rail 13 and the relieved cylinder 14 has its tooth 214 disengaged therefrom. When the rod 116 reaches its extreme right-hand position, the cylinder 15 is relieved and the cylinder 14 is pressurized to lock the rail 13 in its new position. Since the machine 1 is connected with the rail 13 in the manner described, it is stepped to the right to the position shown in FIG. 2 for formation of the third buttonhole. Meanwhile, the cylinder 17 is pressurized to carry the depressurized cylinder to the left in preparation for the further advance of the machine 1 to the right.

During this left-hand movement of cylinder 15, the rail 13 is locked in place against movement by the tooth 214 of cylinder 14.

After the pneumatic cylinder 15 in cooperation with pneumatic cylinders 16 and 17 has advanced the sewing machine 1, in the example described, five times to the right with the sequence of the four strokes enumerated above, the machine 1 is in its extreme right-hand position.

The first sewing cycle of five buttonholes in a first workpiece 21 is terminated and the stitching operation with a second workpiece 31 can begin. The second cycle involves the first formation of a buttonhole in the new workpiece at the same location as the last buttonhole of the first workpiece 21.

In this case, the pneumatic cylinders 15–17 are pressurized in the opposite sequence. In other words, the return stroke of the cylinder 15 now takes place in the opposite direction while the advance stroke of this piston takes place in the same direction as the return stroke of the first cycle.

The stationary pneumatic cylinder 14, which is fixed to the machine frame, serves for immobilizing the rail 13 during advance operations of the latter and consequently, the pneumatic cylinders 14 and 15 are pressurized substantially alternately. Pneumatic cylinder 14 is pressurized when the pneumatic cylinder 15 is de-energized for its return and advance stroke and does not, therefore, cause its tooth 214 to engage the rail during these strokes.

The described pneumatic drive system has been found, at relatively low cost, to provide a reliable movement for the stepwise and intermittent advance and locking of a sewing machine slide by comparison with earlier systems. Neither the displacement nor the braking poses a problem with this system.

The sewing machine installation of the present invention permits, during the automatic sewing operation on one workpiece, the preparation of a second workpiece to be provided with buttonholes in the appropriate locations. In addition, it permits of automatic removal of the first workpiece after termination of the first buttonhole-sewing cycle. In addition, it provides for the automatic transfer of the second workpiece from its preparation station adjacent the sewing path into the sewing location.

The manual effort of service personnel is only required for the removal of the finished workpieces and the preparation of successive workpieces.

The operation of the material feed and removal system is effected by pneumatic servomotors whose control is carried out electronically.

The system for performing these operations is described below.

The workpiece 21 is retained by a tensioning device represented at 20 and serving to stretch the workpiece across the path of the sewing machine 1. Similarly, the workpiece 31 held in readiness for the next sewing operation is retained by a second clamping arrangement 30 which can also form the feed mechanism.

Both of the mechanisms 20 and 30 operate in accordance with the same principle: they grip the workpiece along the opposite outer edges or ends of the intended sewing path with the aid of pneumatic clamps which can be of conventional construction. When these clamps, which can comprise pneumatic cylinders, are pressurized, their pistons bear directly or via force-transmitting levers upon the fabric and hold the fabric against underlying surfaces. Upon relief of the cylinders, the clamps are released and the fabric can be removed or shifted to another position.

Figure 3:
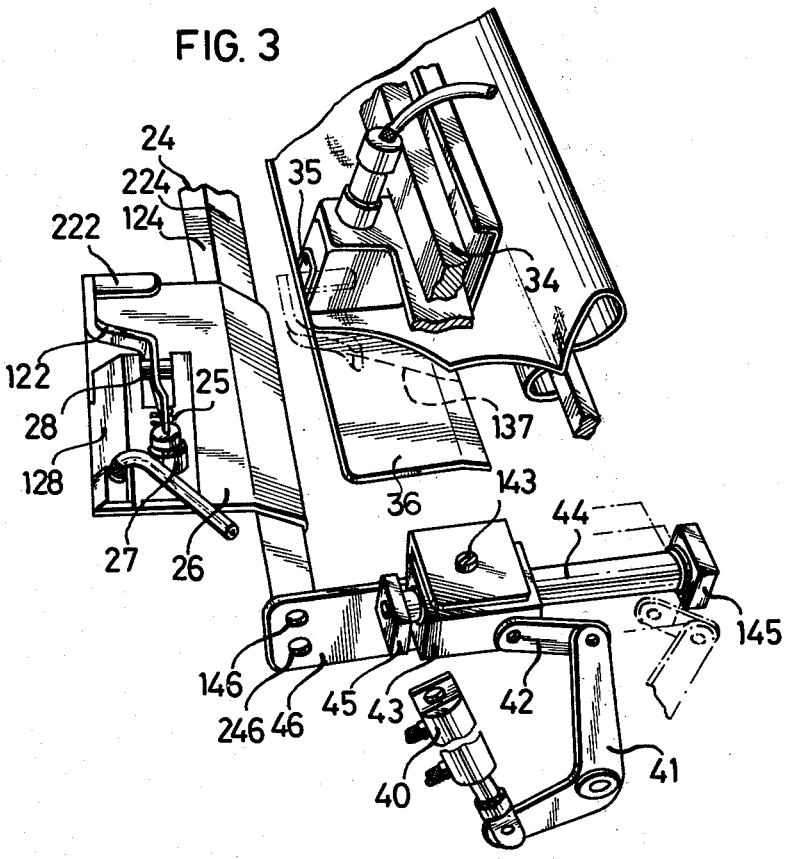
FIG. 3 is an enlarged detail view of the left-hand portion of the tensioning and feed device of FIG. 2 showing the drive for the devices.

The workpiece-clamping mechanism 20 comprises an angle bar 24 which extends along the path of the sewing machine 1 directly beneath the needle 2. This bar is best seen in FIG. 3. The bar can be provided with an opening *24a* to permit the needle to pass through and cooperate with a bobbin provided in the stitching plate of the sewing machine.

The angle bar or rail 24 has a horizontal flange 124 turned toward the sewing machine and constituting a fixed supporting surface for the leading edge of the workpiece, e.g. the workpiece 21 shown in FIG. 2 which can comprise the edge of a shirt or other garment to be provided with buttonholes.

The angle rail 24 in the region of its ends, is formed with angle plates 26 and 126, respectively, upon which clamps 22 and 23 are mounted to press the respective corners of the workpiece against the plates 26 and 126, respectively.

The clamps 22 and 23 are of mirror-image construction and are otherwise structurally identical. The same applies to the clamps 32 and 33 of the clamping and feed device 30. As a result, a description of the clamps 22 and 32 with respect to FIGS. 2 and 3 on the left side of the machine will suffice to describe the corresponding clamps on the opposite side thereof.

The clamp 22 is formed by bending from a reinforced steel strip as a double-arm lever 122 of substantially S configuration and is connected at one end to a short-stroke pneumatic cylinder 27. At its other end, the lever 122 is provided with a clamping projection 222 bent at right angles to the shank of the lever 122 to complete the S shape. It is this projection 222 which holds the fabric against the plate 26. Upon pressurization of the pneumatic cylinder 27, the projection 222 is swung downwardly and retains the fabric against the plate 26. The lever 122 is fulcrumed upon a pin 28 which is fixed in trunnion 128 formed as a bifurcated block mounted upon the plate 26. A restoring spring 25 resists the displacement of the lever 122 upon pressurization of the cylinder 27. When the cylinder 27 is relieved, the spring 25 swings the projection 222 upwardly to release the fabric.

The clamping device 30 for holding the next workpiece 31 in preparation is disposed parallel to the clamping device 20 and is provided with pneumatic clamps 32 and 33 which can be pressurized by the operator upon depression of a foot lever or pedal 4 (FIG. 1). Each clamp comprises, as can be seen for the clamp in FIG. 3, an angle plate 36 to support the fabric. At the opposite end, an angle plate 136 is provided. The broad surfaces of the angle plates 36 and 136 serve to receive and support the workpiece 31 for which they constitute a table on which this workpiece is laid out (FIG. 2). A marker 137, e.g. a synthetic-resin strip cemented to the table, together with a corresponding counterpiece not shown on the opposite side, serves to assist the operator in positioning the workpiece.

The angle piece 36 is juxtaposed with an upright pneumatic cylinder which has a hold-down member 32 and a piston rod therebeneath provided with a fork 35 (FIG. 3) so that on engagement of the workpiece, both ends of the fork 35 press the fabric against the angle plate 36. The same applies to the hold-down member 33 of angle plate 136. From hold-down member 32 to hold-down member 33, there extends a cable passage for supply lines which can be a rectangular-section tube. The cable duct 34 carries at its center a nozzle tube 234 which extends over the intermediate section of the workpiece 21 and is formed with a multiplicity of downwardly trained air outlet or nozzles 134.

When compressed air is fed to the nozzle tube 234, the air flows from the nozzles or orifices 134 against the workpiece 21. When the clamps 23 and 23 of the workpiece-tensioning device 20 are no longer actuated, the released workpiece 21 is thereby blown downwardly along the downwardly inclined shank 224 of the angle rail 24 by the air stream from the nozzle tube 234.

In the region of the clamps 32 and 33, there are provided walls 238 or 338 upon which respective strippers 38 and 138 are mounted. These strippers 38 and 138 are connected with pneumatic cylinders 39 and 139 shown in broken lines behind the walls 238 and 338. These cylinders serve to swing the strippers 38 and 138 which are formed as stirrup-shaped bent heavy wires. The stripper 38 is swung in the clockwise sense while the stripper 138 is swung in the counterclockwise sense.

The pivotal displacement of the strippers 38 and 138 is triggered upon the transfer of the prepared workpiece 31 to the clamping mechanism 20 because the workpiece 31 is only clamped laterally and is not supported in its central regions. The swinging of the strippers 38 and 138 serves to smooth and slightly stretch the workpiece 31 transversely to facilitate the transfer.

In order to effect the transfer of the workpiece 31 held in the clamping device 30 in preparation for the transfer, into the clamping device 20 so that the next sewing operation can commence, a transfer mechanism is provided as described below.

A double-acting pneumatic cylinder 40 has a piston connected with a bell crank lever 41 and a pivot. The bell crank lever 41 is provided in turn with a link 42 to which it is articulated and which is connected to a rectangular slide block 43 composed of a low-friction material such as nylon and provided at the region of its greatest cross section with a central bore in which a guide bar 44 is received. The ends of the guide bar 44 are secured by the opposite flanges 45 and 145 to portions of the frame not shown. Upon advance of the piston from the cylinder 40, the bell crank lever 41 is swung in the clockwise sense and draws the slide block 43 to the right into the position shown in dot-dash lines.

The slide block 43 is provided with a screw 143 which connects a traction bracket 46 to the slide block 43. The bracket 46 is connected, in turn, to the angle rail 24 so that the latter, with the entire clamping mechanism 20, is displaced laterally to the right so that the surface 124 underlies the plate 36.

The clamping projection 222 of the clamp 22, as can be seen in broken lines in FIG. 3, passes into the fork 35 and thereupon engages the workpiece 31 (FIG. 2).

The same applies for the clamp 33 and the clamping lever 223.

The bracket 46 is an L-shaped stamped piece of metal whose vertical arm is approximately at its center bent at right angles and has its leg overhanging the block 43 attached with a screw 143 thereto. The horizontal branch of the bracket 46 is provided with two holes 146 and 246 disposed one above the other so that it can be connected by screws to the angle rail 24.

When the piston 40 is pressurized again in the opposite sense so as to retract its piston, the block 43 is shifted to the left and carries the rail 24 with the previously prepared workpiece 31 clamped therein to the left beneath the sewing machine needle for the second cycle of operations of the sewing machine.

Thus, at the end of a working cycle whereby, for example, five buttonholes are produced, the workpiece 21 is released by the clamps 22 and 23 which are opened. This fabric workpiece is then blown downwardly rapidly in the manner described and the new fabric workpiece 31 is picked up and brought into the working position. Naturally, the clamps 33 and 35 are released to enable the new fabric workpiece 31 to be engaged by the clamping mechanism 20 previously described.

The fabric-removal device can, in the apparatus of the present invention, be constituted relatively simply. For example, all of the workpieces including those previously provided with buttonholes and those to be provided with buttonholes can be retained along an opposite edge from that to carry the buttonholes in a further stack clamp 51 constituting a material holder. This clamp 51 has been shown in FIG. 2 and uses the weight of the material to cause the fabric pieces which have not yet been buttonholed and those which have previously been buttonholed to hang downwardly. The nozzle tube 234 merely serves to accelerate the downward movement of the previously buttonholed fabric.

The stack or bundle clamp 51 is provided ahead of the clamping devices 20 and 30 and comprises a rectangular-cross-section stationary clamping beam 54 which can be provided on its ends with respective pneumatic cylinders, only one of which can be seen at 53 in FIG. 2. The piston rods of these cylinders are each connected with a clamping rod 52 by respective articulations so that, when the pistons are pressurized, the bundle of fabric is clamped between the bar 52 and the bar 54.

On the right-hand side of the bar 54 shown in FIG. 3, the fabric pieces 60, 61 and 62 to be subsequently provided with buttonholes, hang downwardly. The operator takes these pieces one after another and secures them in the clamping device 30 as has been shown for the workpiece 31. The fabric pieces are thus fed like the pages of a book with the downwardly hanging edges successively into position. The previously buttonholed fabric pieces hang downwardly to the left of the bar 54 as has been shown for the fabric pieces 70, 71 and 72.

When the entire bundle of fabric pieces has been buttonholed, the cylinders 53 are relieved, the bundle is removed from beneath the clamping bars 52 and 54, and a new bundle is inserted. The entire bundle of buttonholed fabric can be transferred to subsequent operating stations, e.g. for the sewing together of front and rear portions of the garment.

The circuit diagram of FIG. 5 shows the control system for the operation of the apparatus, especially the automatic feeding thereof with new workpieces and the discharging of buttonholed workpieces after the fabrication of five buttonholes therein.

Referring again to FIG. 2, it will be apparent that the machine is in a position in which, after the first buttonhole 19 and the second buttonhole 119 have been formed, the machine 1 is disposed to produce the third buttonhole. Five buttonholes in all will be produced in the workpiece 21.

The operator has already positioned a second workpiece 31 on the mark 137 and hence in the correct orientation to be engaged by the clamping device 20 for producing five buttonholes on this new fabric piece.

The operator then actuates the pedal 4 (FIG. 1) whereby the contacts C4 of this pedal (FIG. 5) is closed.

Contact C4, as is the case with all contacts to be described hereinafter, is connected with a programming circuit 60 which can be an electromechanical programmer using a programmed drum or an electronic programmer using logic circuitry, for the sequential operation of the pneumatic cylinders for the charging of the apparatus and/or the actuation of the sewing machine.

The circuit 60 is connected by the two-conductor cable 61 with the line current source and has another two-conductor cable 62 connected with the sewing machine 1, i.e. the motor thereof.

Upon the closing of contact C4, magnetic valve M1 is triggered, the magnetic valve M1, as is the case with all the other magnetic valves of FIG. 5, namely valves M2–M16, being of commercial construction and connected to the logic or programming circuit 60. These magnetic valves are connected between the respective pneumatic cylinders previously described and a source of compressed air. The magnetic valves serve to pressurize and relieve these cylinders.

When the contacts C4 close, the two single-action cylinders shown in FIG. 5 at D1 and corresponding to the cylinders of clamps 32 and 33 are pressurized so that the workpiece 31 positioned in the clamping device 30 is engaged and held in place in the manner previously described. At the conclusion of the previous sewing cycle, the completed workpiece 21 is discharged. Only the pedal 4 is actuated by the operator to enable the programming circuitry 60 to begin the next operation and repeat the process in appropriate time relationship. The process can be controlled by limit switches at the end of the moving path of the sewing machine or some other movable part of the system. Contacts C1 operate via the magnetic valve M2 the opening of the clamps 22 and 23 to release the fabric piece 21 by relieving their pneumatic cylinders represented at D2 in FIG. 5. The workpiece 21, however, remains retained by the bundle clamp 51 and, as soon as the clamps 22 and 23 have opened, the programmer automatically closes contacts C2 of the magnetic valve M3 to operate the pneumatic cylinder D3 and thereby admit fluid under pressure to the nozzle tube 234, thereby accelerating the downward movement of the buttonholed edge of workpiece 21.

Contact C3*a* is then closed, this contact forming together with contact C3*b* an alternating switch. The closing of contact C3*a* triggers the pressurization of one side of the double-acting pneumatic cylinder 40 (represented at D4 in FIG. 5) so that the clamping device 20 is moved to the clamping device 30 in order to pick up the new workpiece 31, the clamps 22 and 23 being open during this operation.

Contacts C4 close and operate via the magnetic valve M5 the closing of the pneumatic cylinder D2 of the clamps 22 and 23 of the clamping device 20. The workpiece 31 is thereby engaged in this device.

Contacts C5 open to relieve the cylinders D2 of the clamps 32 and 33 via magnetic valve M5 of FIG. 5 and the workpiece 31 is released.

Contacts C6 close and, via magnetic valve M7, operate the pneumatic cylinders 39 and 139 (cylinders D6 in FIG. 5) to actuate the strippers 38 and 138 to stretch the fabric. Simultaneously with the actuation of cylinders D6, the contacts C3*a* and C3*b* reverse and pressurize the opposite side of double-acting pneumatic cylinder 40 (cylinder D4 in FIG. 5) so that the clamping mechanism 20 is displaced toward the sewing machine to bring the second workpiece 31 into place. Meanwhile, the clamping device 30 is ready to receive a further workpiece.

Contacts C7 are closed and the presser foot 3 of the sewing machine 1 is lowered via the electromagnet M9. A further contact C8 closes to turn on the sewing machine 1 and the stitching of the first buttonhole begins. After sewing of the bead stitches and the end stitches to lock the thread of the buttonhole and and actuation of the blade to cut the fabric between the bead stitches, the sewing machine is turned off via contact C9 and the foot 3 is raised via contact C10 so that the next displacement of the sewing machine 1 can be effected. Pneumatic cylinder 15 is pressurized by closure of the contact C11 via the electromagnetic valve M10 and engages the rail 13. Pneumatic cylinder 14 is relieved via contacts C12 and electromagnetic valve M11 while pneumatic cylinder 16 is pressurized by contacts C13 and magnetic valve M12.

The pneumatic cylinder 15 thus entrains the indexing rail 13 and the machine 1 to the right in FIG. 4 through one stroke length. Pneumatic cylinder 15 is then relieved via contact C14 and electromagnetic valve M13 while pneumatic cylinder 14 is pressurized by contacts C15 and electromagnetic valve 14.

The pneumatic cylinder 16 is then vented while the pneumatic cylinder 17 is pressurized via contacts C16 and electromagnetic valve M15 for the return stroke of the piston 116. This working cycle is repeated until the desired number of buttonholes, usually five, is sewn.

I claim:

1. In a method for sewing a succession of stitch-groups in a workpiece in which a fabric workpiece is clamped and a relative displacement of a stitch-group sewing machine and a workpiece is carried out in a stepwise manner to form the successive stitch-groups in spaced-apart relationship in said workpiece the improvement wherein the workpieces held in the clamp are replaced successively and after the formation of a succession of stitch-groups in one workpiece by relative displacement in one direction, stitch-groups are formed in the successive workpiece by relative displacement in the opposite direction.

2. The improvement defined in claim 1 wherein said stitch-groups are rows of buttonholes.

3. The improvement defined in claim 2 wherein the workpiece is held stationary for the formation of the stitch-groups therein, and the sewing machine is moved in stepwise fashion along each workpiece.

4. A sewing machine installation for producing successive rows of stitch-groups in a succession of fabric pieces comprising:

(a) a support;
(b) means on said support forming a rectilinear path;
(c) a sewing machine mounted on said path and displaceable linearly therealong;
(d) means for the stepwise advancing of said sewing machine in opposite directions along said path;
(e) clamping means on said support for retaining a fabric workpiece for cooperation with said sewing machine to form a succession of stitch-groups in spaced relation in said workpiece;
(f) means adjacent said clamping means for retaining a second workpiece in an extended prepared condition preparatory to insertion into said clamping means;
(g) transfer means for shifting a prepared second workpiece into the path of said sewing machine and engagement with said clamping means; and
(h) means for discharging a workpiece from said clamping means upon completion of the stitching of a plurality of stitch-groups therein.

5. The installation defined in claim 4 wherein said support is provided with a horizontal guideway, a plate movable along said guideway and carrying said sewing machine, an indexing rail on said plate, double-acting fluid pressure means including a member displaceable horizontally and parallel to said rail and means on said member selectively engaging said rail for entraining said plate along said guideway.

6. The installation defined in claim 5 wherein said member is a piston rod, and said fluid pressure means include a pair of oppositely effective cylinders having respective pistons connected with said rod, said rod being provided with a pneumatic cylinder having a piston engageable with said indexing rail.

7. The installation defined in claim 6, further comprising a further pneumatic cylinder fixed upon said support and having a piston engageable with said rail to retain said plate against displacement during a return movement of said rod.

8. The installation defined in claim 4 wherein adjacent the first-mentioned clamping means there is provided a second clamping means, each of said clamping means being provided at opposite extremeties along the path of said sewing machine with respective pneumatically operated clamps engageable with the first and second workpieces respectively, said second clamping means being provided with marking means enabling the positioning of said second workpiece preparatory to its transfer to said first clamping means.

9. The installation defined in claim 8 wherein said first clamping means is operatively connected to a pneumatic cylinder means for displacing said first clamping means toward second clamping means, the clamps of said first clamping means including members engageable with a fabric retained by said second clamping means to draw said fabric toward said sewing machine.

10. The installation defined in claim 4 wherein said support is provided with a bundle clamp engageable with a stack of fabric workpieces adapted to be successively disposed in said clamping means and retaining workpieces formed with such stitch groups thereafter.

11. The installation defined in claim 4 wherein said support is provided with clower means adapted to direct at least one jet of air against a workpiece retained in said clamping means to deflect said workpiece downwardly upon release of said workpiece by said clamping means.

12. The installation defined in claim 4 wherein said clamping means comprise an angle rail having a horizontal shank forming a supportive surface for a workpiece to be engaged by said clamping means, a downwardly inclined shank for guiding workpieces downwardly upon release by said clamping means, and pneumatic means for accelerating a released workpiece downwardly along said inclined front.

13. An apparatus for producing rows of buttonholes in a bundle of workpieces comprising:

a support frame;
guide means on said support frame defining a horizontal displacement path;
bearing means slidable horizontally along said guide means;
a horizontal plate affixed to said bearing means;
a buttonhole sewing machine mounted upon said plate;
an indexing rail fixed to said bearing means and provided with a multiplicity of downwardly open notches, said rail extending horizontally;
a pneumatic locking means fixed to said support frame and including a tooth engagable with said rail for retaining said machine temporarily against displacement during the formation of a buttonhole thereby;
a pair of oppositely effective horizontal cylinders mounted on said support frame and provided with respective pistons, one of said cylinders being fixed on said support frame, the other of said cylinders being horizontally adjustable therealong;
a common piston rod connected to said pistons and displaceable horizontally;
a pneumatic detent mounted on said rod and having a tooth engageable in one of said notches for entraining said rail and said plate with said rod in stepwise movement;
first clamping means mounted on said support frame for movement transversely of the direction of displacement of said sewing machine horizontally toward and away from said sewing machine, said first clamping means having a pair of pneumatically operated first clamps at opposite ends of said first clamping means, said first clamping means being engageable with a fabric workpiece for retaining same, in a position of said first clamping means proximal to said sewing machine, for the sewing of a succession of buttonholes in said workpiece upon displacement of said sewing machine in one direction;
second clamping means disposed adjacent said first clamping means and having a pair of spaced-apart second clamps, engageable with a second workpiece for retaining preparatory to its introduction into said first clamping means for the stitching of a succession of buttonholes therein upon movement of said sewing machine in the opposite direction;
means for displacing said first clamping means toward said second clamping means to engage a second workpiece in said first clamps whereby said second workpiece is carried toward said machine upon displacement of said first clamping means toward said machine;

pneumatic deflecting means on said support training a plurality of jets of air against a workpiece retained by said first clamping means for deflecting said workpiece downwardly; and a bundle clamp mounted on said support frame for retaining a bundle of workpieces whereby one workpiece from said bundle of workpieces can be engaged in said clamping means, another workpiece from said bundle is engageable in said second clamping means, and further workpieces to be buttonholed hang downwardly.

* * * * *